US006766657B1

(12) United States Patent
Chien

(10) Patent No.: US 6,766,657 B1
(45) Date of Patent: Jul. 27, 2004

(54) JEWELRY CARRYING A MINIATURE ROULETTE WHEEL

(76) Inventor: Li Chen Chien, No.1, Lane 247, Shiner Rd., Shinyi Chiu, Keelung (TW), 201

( * ) Notice: Subject to any disclaimer, the term of this patent is extended or adjusted under 35 U.S.C. 154(b) by 0 days.

(21) Appl. No.: 10/338,338

(22) Filed: Jan. 7, 2003

(51) Int. Cl.[7] ..... A44C 19/00

(52) U.S. Cl. ..... 63/15.1; 63/31; 44/236; 44/243

(58) Field of Search ..... 63/15.1, 31; 446/236, 446/243

(56) References Cited

U.S. PATENT DOCUMENTS 397,774 A * 2/1889 Briggs ..... 63/1.13
566,617 A * 8/1896 Patterson ..... 40/1.6
1,333,284 A * 3/1920 Schreiber ..... 40/639
1,672,355 A * 6/1928 Ullman ..... 63/1.13
1,857,902 A * 5/1932 Weber ..... 273/143 E
2,177,978 A * 10/1939 Darvie ..... 116/315
2,427,257 A * 9/1947 Campbell ..... 63/20
2,785,488 A * 3/1957 Brooks ..... 40/503
3,968,661 A * 7/1976 Williams ..... 63/31
4,077,237 A * 3/1978 Loper ..... 63/31
4,184,344 A * 1/1980 Pepin ..... 63/31

* cited by examiner

*Primary Examiner*—J. J. Swann
*Assistant Examiner*—Dinesh Melwani

(57) ABSTRACT

A jewelry having a jewelry body, for example, a fashion ring or pendant, and a miniature roulette wheel mounted on the jewelry body. The miniature roulette wheel includes a plurality of rotating wheels respectively fastened pivotally with the jewelry body, each rotating wheel having at least one display unit divided into a plurality of display sectors respectively marked with a respective numerical symbol, and an indicator fixedly fastened to the jewelry body and adapted to point out the numerical symbol of one display sector of each display unit of each rotating wheel.

14 Claims, 9 Drawing Sheets

JEWELRY CARRYING A MINIATURE ROULETTE WHEEL

BACKGROUND OF THE INVENTION

1. Field of the Invention

The present invention relates to jewelry and, more particularly, to a jewelry carrying a miniature roulette wheel.

2. Description of Related Art

A woman may wear a fashion ring on the finger or a pendant round the neck as an ornament. These personal items arc for the purpose of decoration only.

SUMMARY OF THE INVENTION

The present invention has been accomplished under the circumstances in view. It is the main object of the present invention to provide a jewelry, which carries a miniature roulette wheel for gambling. It is another object of the present invention to provide a jewelry, which can be used as a personal ornament as well as a gambling apparatus for drawing lucky numbers. To achieve these and other objects of the present invention, the jewelry comprises a jewelry body, for example, a fashion ring or pendant, and a miniature roulette wheel mounted on the jewelry body. The miniature roulette wheel comprises a plurality of rotating wheels respectively fastened pivotally with the jewelry body, each rotating wheel having at least one display unit divided into a plurality of display sectors respectively marked with a respective numerical symbol, and an indicator fixedly fastened to the jewelry body and adapted to point out the numerical symbol of on Other objects, advantages, and novel features of the invention will become more apparent from the following detailed description when taken in conjunction with the accompanying drawings.

DETAILED DESCRIPTION OF THE PREFERRED EMBODIMENT

Figure 1:
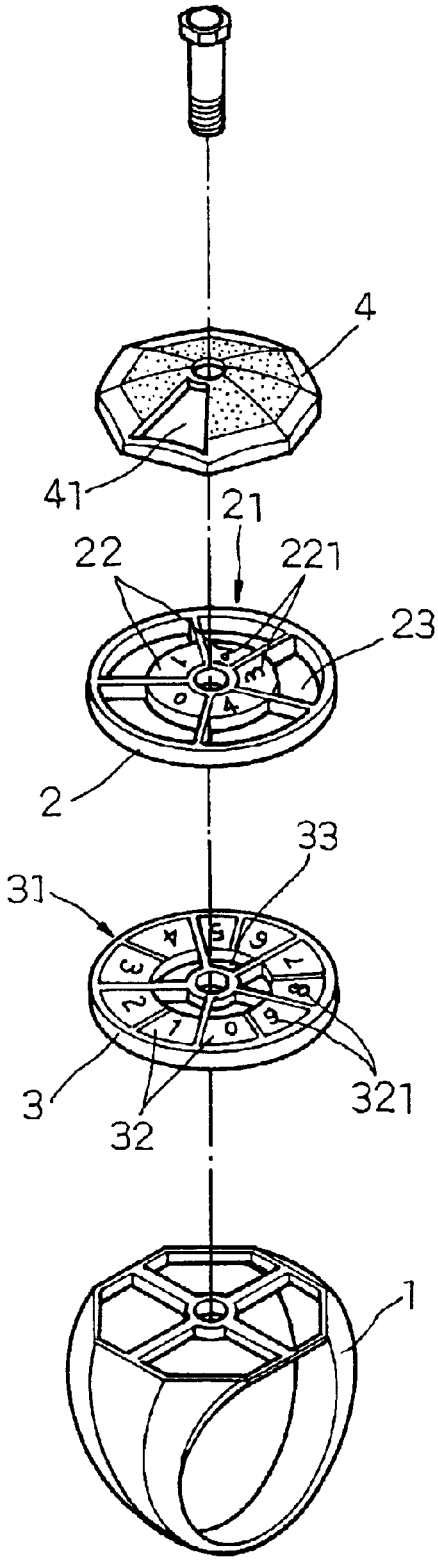
FIG. 1 is an exploded view of the first embodiment of the present invention.
Figure 2:
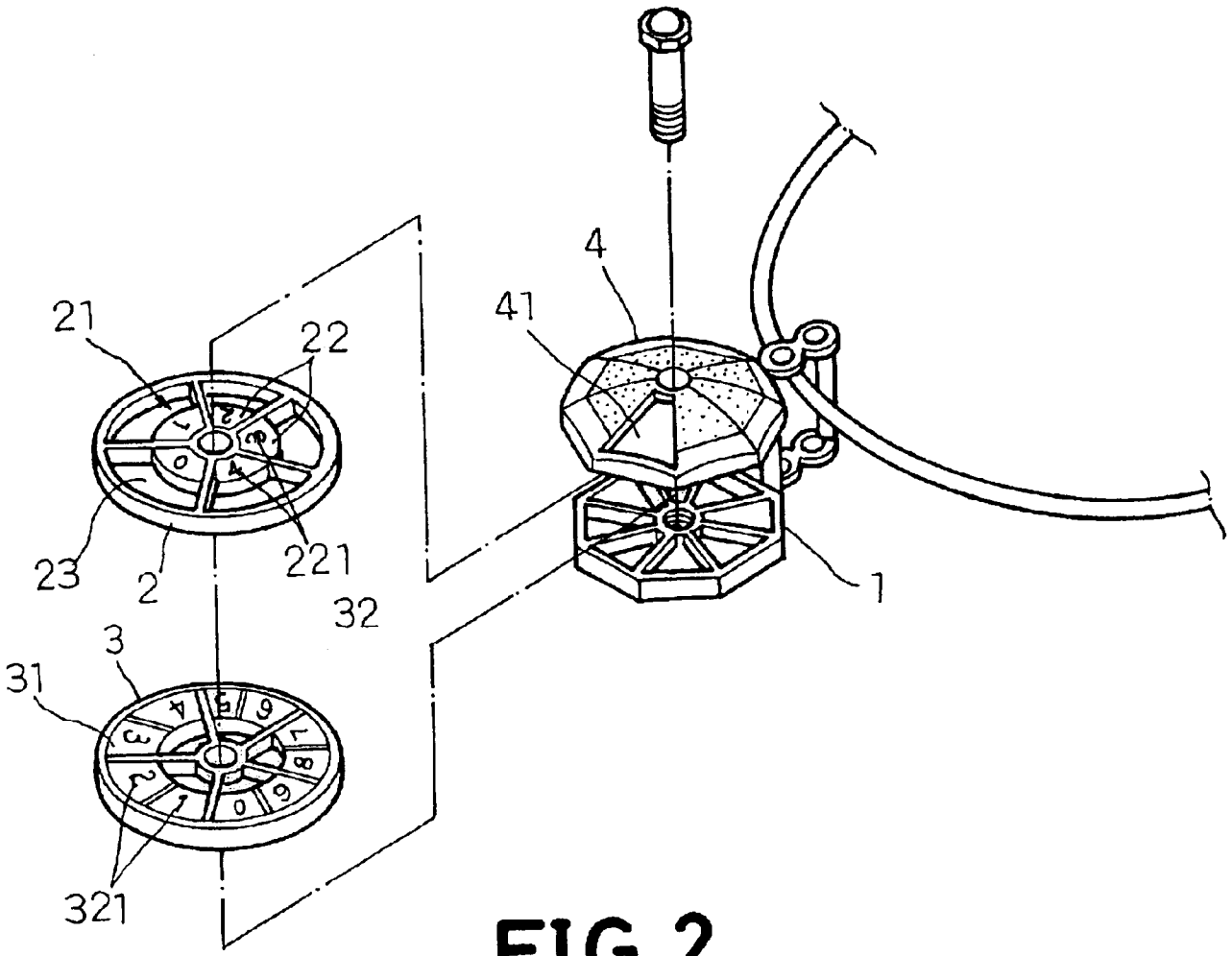
FIG. 2 is an exploded view of an alternate form of the first embodiment of the present invention.
Figure 3:
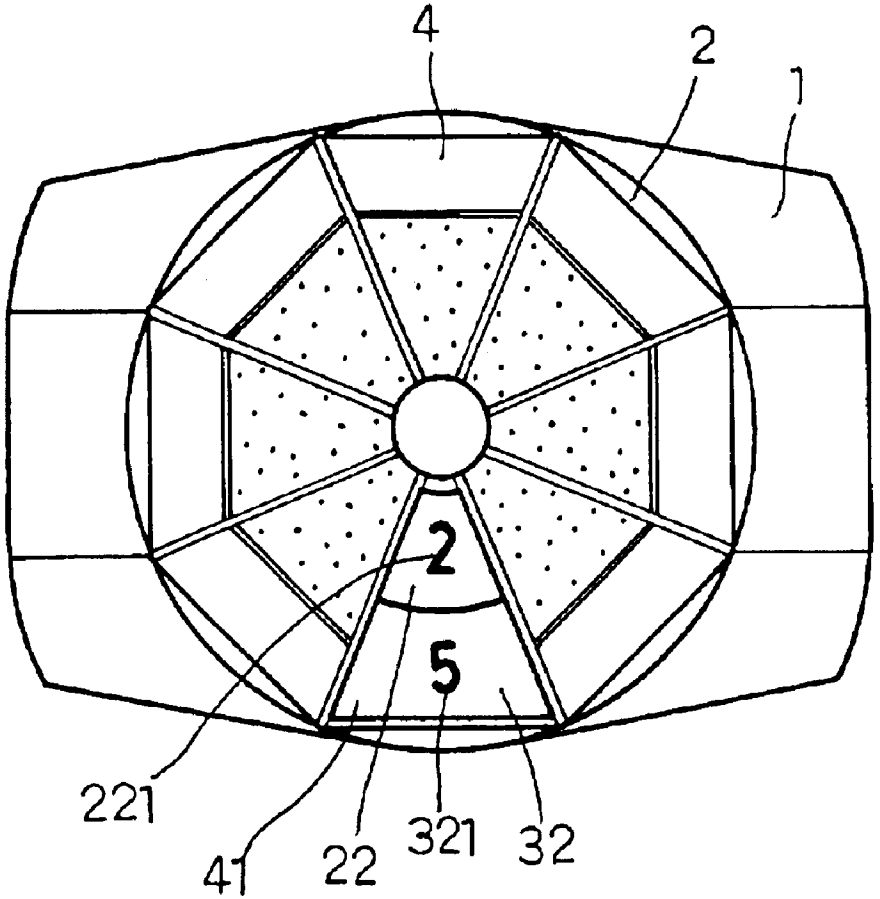
FIG. 3 is a top view in an enlarged scale of the first embodiment of the present invention.

Referring to FIGS.1~3, a jewelry and miniature roulette wheel arrangement in accordance with the first embodiment of the present invention is shown comprised of a jewelry body 1, a first rotating wheel 2, a second rotating wheel 3, and an indicator 4. The indicator 4 is fixedly fastened to the jewelry body 1. The first rotating wheel 2 is fastened pivotally with the jewelry body 1 and spaced between the jewelry body 1 and the indicator 4. The second rotating wheel 3 is fastened pivotally with the jewelry body 1 and spaced between the jewelry body 1 and the first rotating wheel 2. The jewelry body 1 may be variously embodied. For example, the jewelry body 1 can be a fashion ring for mounting on one's finger as an ornament (see FIG. 1), or a necklace for wearing round the neck as an ornament (see FIG. 2). The first rotating wheel 2 comprises a display unit 21 divided into multiple display sectors 22 respectively marked with a respective numeral or numerical sign 221, and sector openings 23 spaced around the display unit 21. The second rotating wheel 3 comprises a display unit 31 divided into multiple display sectors 32 corresponding to the sector openings 23 of the first rotating wheel 2 and respectively marked with a respective numeral or numerical sign 321, and sector openings 33 corresponding to the display sectors 22 of the display unit 21 of the first rotating wheel 2. The indicator 4 has a view window 41 through which one display sector 22 of the first rotating wheel 2 and one display sector 32 of the second rotating wheel 3 are seen. When the first rotating wheel 2 and the second rotating wheel 3 are stopped after having been forced to rotate relative to the jewelry body 1 and the indicator 4, a particular numeral 221 of the first rotating wheel 2 and a particular numeral 321 of the second rotating wheel 3 are seen through the view window 41 of the indicator 4 (see FIG. 3).

Figure 4:
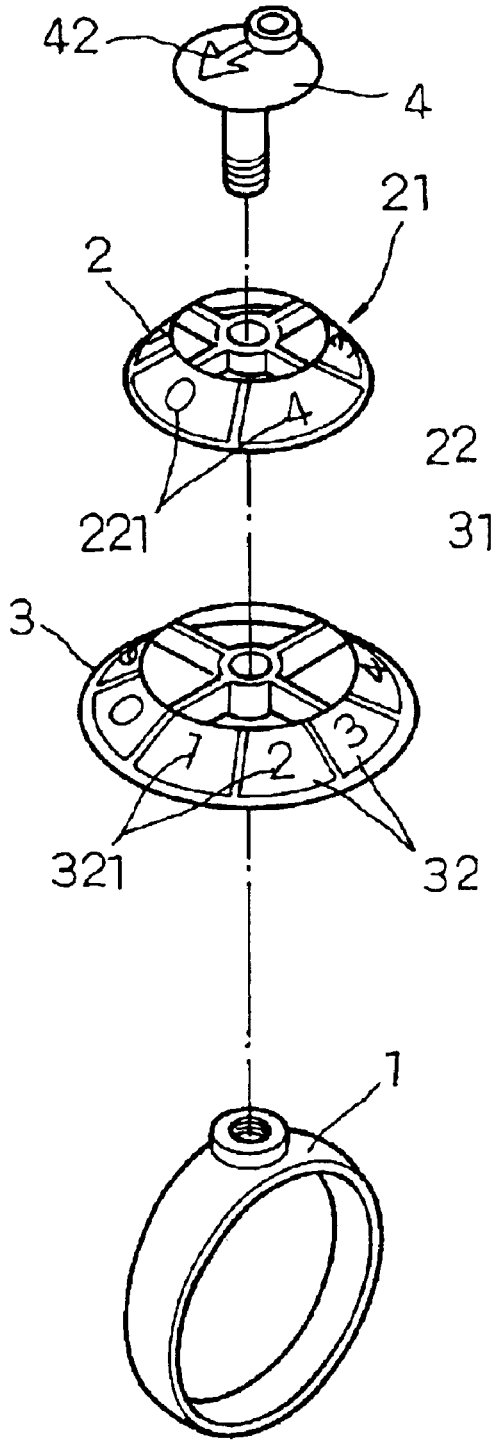
FIG. 4 is an exploded view of the second embodiment of the present invention.
Figure 5:
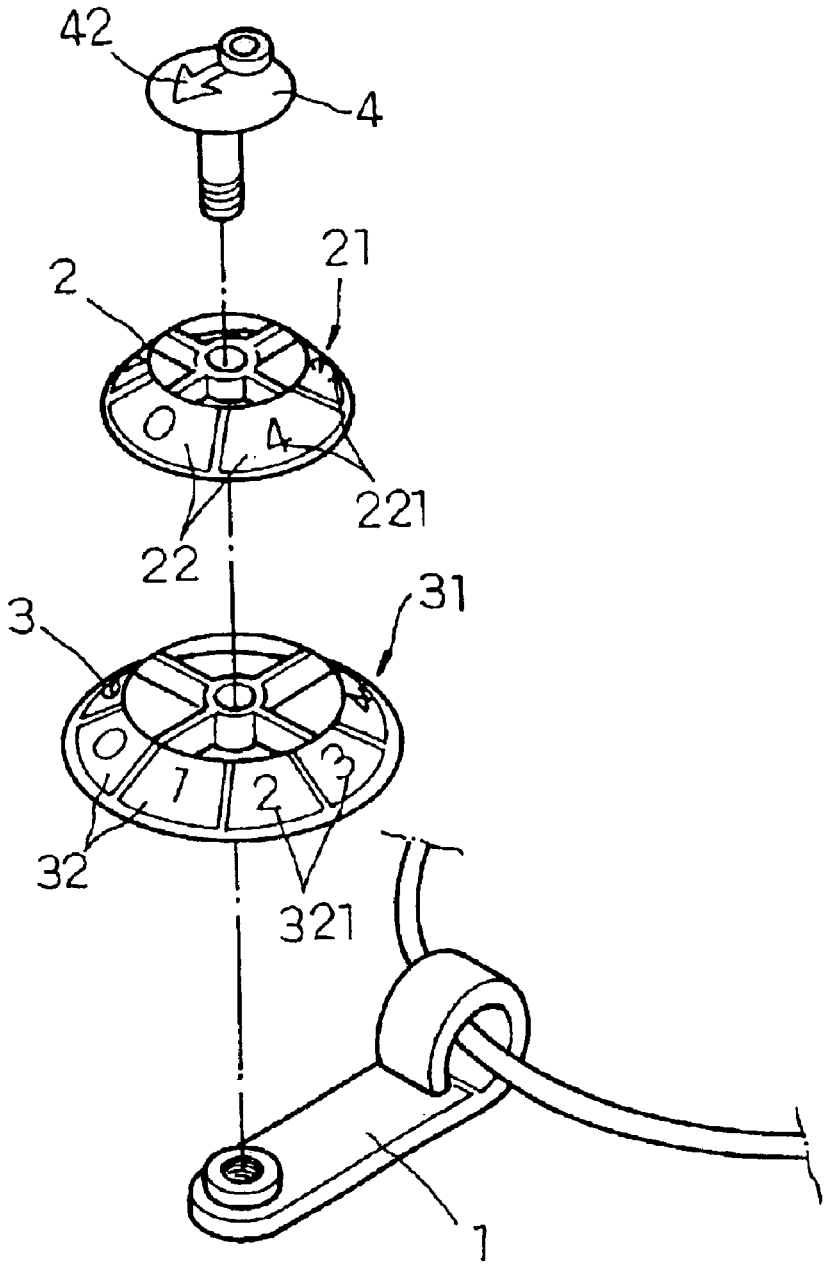
FIG. 5 is an exploded view of an alternate form of the second embodiment of the present invention.
Figure 6:
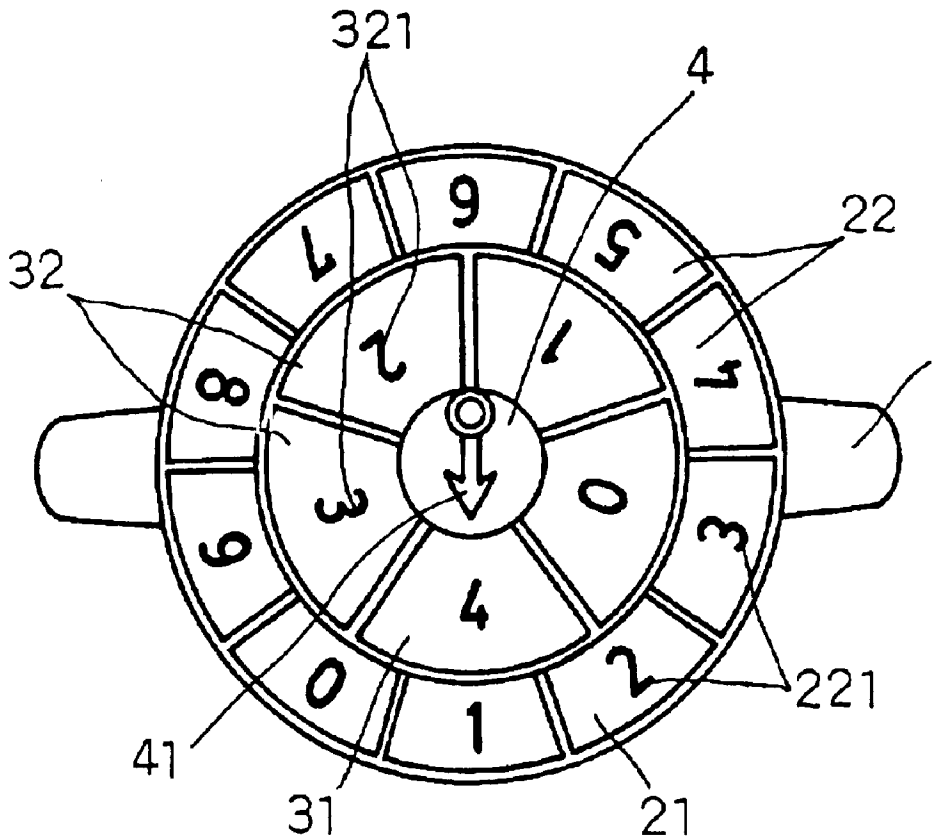
FIG. 6 is a top view in an enlarged scale of the second embodiment of the present invention.

FIGS. 4~6 show a jewelry and miniature roulette wheel arrangement in accordance with the second embodiment of the present invention. This second embodiment is comprised of a jewelry body 1, a first rotating wheel 2, a second rotating wheel 3, and an indicator 4. The jewelry body 1 may be variously embodied. For example, the jewelry body 1 can be a fashion ring for mounting on one's finger as an ornament (see FIG. 14), or a necklace for wearing round the neck as an ornament (see FIG. 5). The jewelry body 1 comprises a display unit 21 divided into multiple display sectors 22 respectively marked with a respective numeral or numerical sign 221. The second rotating wheel 3 comprises a display unit 31 divided into multiple display sectors 32 and respectively marked with a respective numeral or numerical sign 321. The indicator 4 has a pointer 41, which indicates one display sector 22 of the first rotating wheel 2 and one display sector 32 of the second rotating wheel 3. The first rotating wheel 2 and the second rotating wheel 3 are respectively fastened pivotally with the jewelry body 1. The display unit 32 of the second rotating wheel 3 is spaced around the display unit 22 of the first rotating wheel 2. When the first rotating wheel 2 and the second rotating wheel 3 are stopped after having been forced to rotate relative to the jewelry body 1 and the indicator 4, the pointer 41 of the indicator 4 points out a particular numeral 221 of the first rotating wheel 2 and a particular numeral 321 of the second rotating wheel 3 (see FIG. 6)

Figure 7:
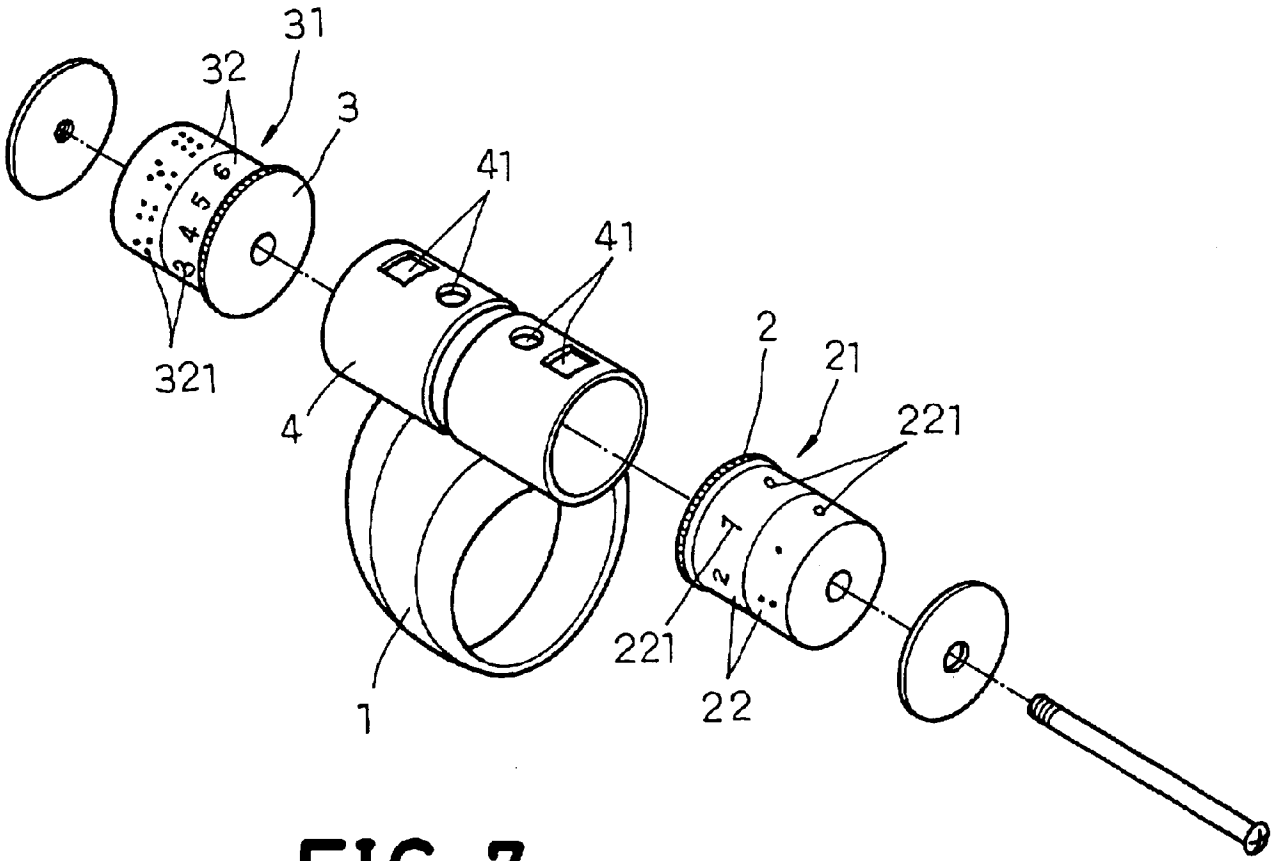
FIG. 7 is an exploded view of the third embodiment of the present invention.
Figure 8:
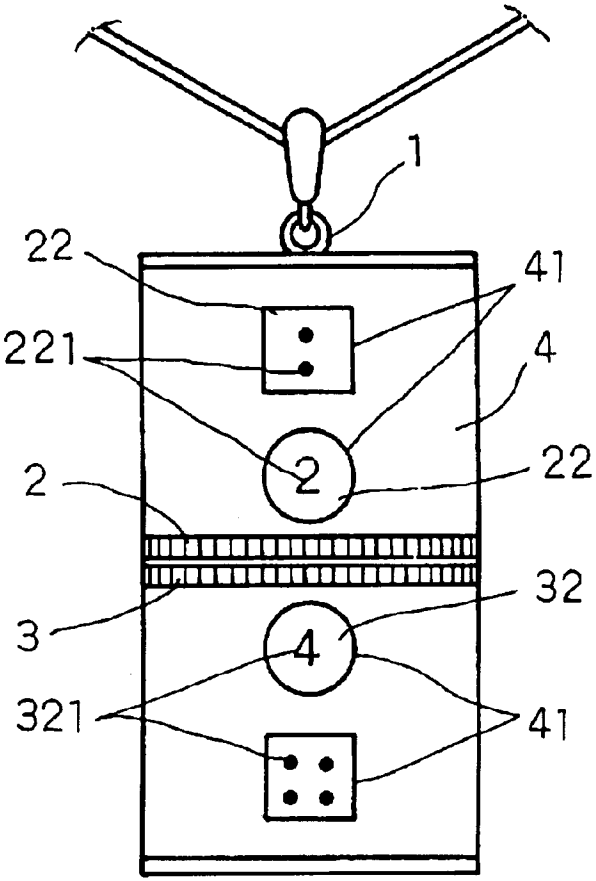
FIG. 8 is an assembly plain view of an alternate form of the third embodiment of the present invention.
Figure 9:
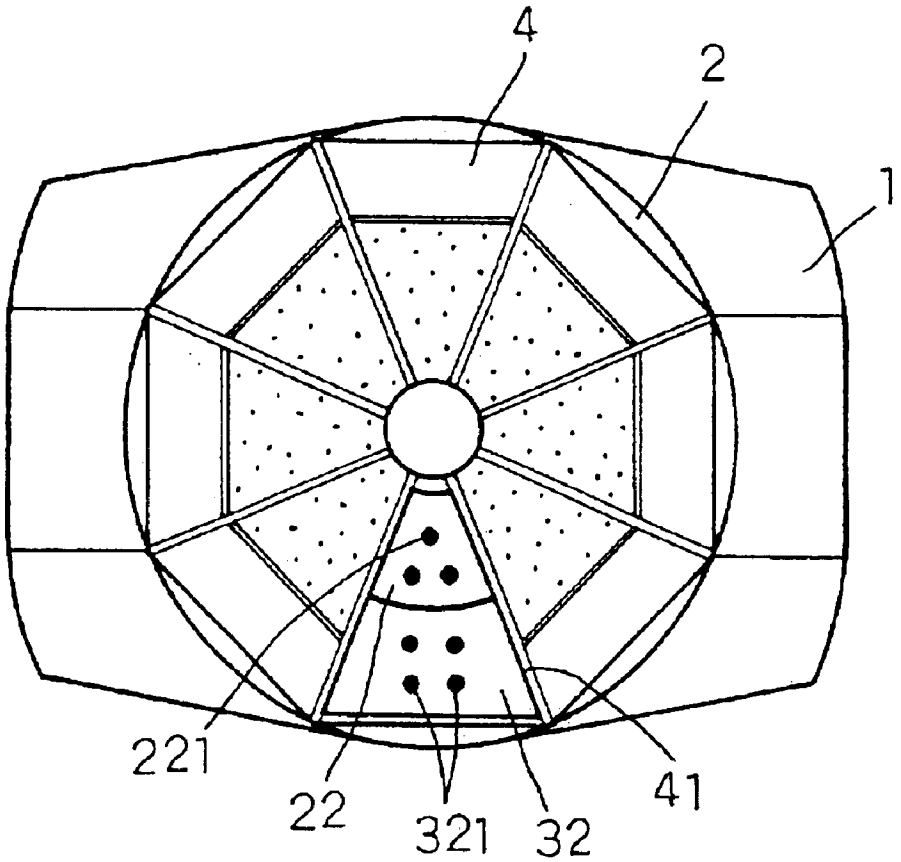
FIG. 9 is similar to FIG. 3 but showing the display sectors of the first and second rotating wheels marked with dots.

FIGS. 7 and 8 show a jewelry and miniature roulette wheel arrangement in accordance with the third embodiment of the present invention. This third embodiment is comprised of a jewelry body 1, a first rotating wheel 2, a second rotating wheel 3, and an indicator 4. The jewelry body 1 may be variously embodied. For example, the jewelry body 1 can be a fashion ring for mounting on one's finger as an ornament. The indicator is a tubular member fixedly fastened to the jewelry body 1, having a plurality of view windows 41. The first rotating wheel 2 and the second rotating wheel 3 are respectively fastened pivotally with and received inside the indicator 4, each having a plurality of display units 21 or 31 around the periphery. Each display unit 21 or 31 is divided into multiple display sections 22 or 32 respectively marked with a respective numeral or numerical sign 221 or 321. Through the view windows 41, the sign 221 of one display section 22 of each display unit 21 of the first rotating wheel 2 and the sign 321 of one display section 32 of each display unit 31 of the second rotating wheel 3 are seen. When the first rotating wheel 2 and the second rotating wheel 3 are stopped after having been forced to rotate relative to the jewelry body 1 and the indicator 4, a particular numeral (or numerical sign) 221 of each display unit 22 of the first rotating wheel 2 and a particular numeral (or numerical sign) 321 of each display unit 32 of the second rotating wheel 3 are seen through the view windows 41 of the indicator 4.

Referring to FIG. 9 and FIGS. 1~8, the numerals or numerical signs 221 and 321 can be Arabic numerals, character symbols, dots, Braille, etc.

Although the present invention has been explained in relation to its preferred embodiments, it is to be understood that many other possible modifications and variations can be made without departing from the spirit and scope of the invention as hereinafter claimed.

What is claimed is:

1. A piece of jewelry comprising:

a roulette wheel mounted on a jewelry body, said roulette wheel comprising:

at least one rotating wheel fastened to said jewelry body and having at least one display unit divided into a plurality of display sectors marked with a numerical symbol, and an indicator means fastened to said jewelry body and adapted to point out a numerical symbol of one display sector of each display unit of said at least one rotating wheel; wherein said at least one rotating wheel comprises at least one first rotating wheel and at least one second rotating wheel fastened to said jewelry body, said at least one first rotating wheel comprising a display unit divided into multiple display sectors each marked with a respective numerical symbol and a plurality of sector openings spaced around the display unit of the respective first rotating wheel, said at least one second rotating wheel comprising a display unit divided into multiple display sectors corresponding to the sector openings of said at least one first rotating wheel and a plurality of sector openings corresponding to the display sectors of one display unit of said first rotating wheel, each display sector of said second rotating wheel being marked with a respective numerical symbol; and said indicator means has a view window through which the numerical symbol of one display sector of said at least one first rotating wheel and the numerical symbol of one display sector of said at least one second rotating wheel are seen.

2. The jewelry as claimed in claim 1, wherein said at least one rotating wheel comprises at least one first rotating wheel and at least one second rotating wheel fastened to said jewelry body, said at least one first rotating wheel comprising a display unit divided into multiple display sectors each marked with a respective numerical symbol, said at least one second rotating wheel comprising a display unit divided into multiple display sectors spaced around the display unit of one of said at least one first rotating wheel and marked with a respective numerical symbol; and said indicator means has a pointer adapted to point out the numerical symbol of one display sector of each of said at least one first rotating wheel and the numerical symbol of one display sector of each of said at least one second rotating wheel.

3. The jewelry as claimed in claim 1, wherein said at least one rotating wheel comprises at least one first rotating wheel and at least one second rotating wheel fastened to and received in said indicator means at two sides, said at least one first rotating wheel and said at least one second rotating wheel each comprising at least one display unit extended around the periphery thereof, said at least one display unit being divided into multiple sectors each marked with a respective numerical symbol; and said indicator means is a tubular member fixedly fastened to said jewelry body, having a plurality of view windows through which the numerical symbol of one display sector of one display unit of said at least one first rotating wheel and the numerical symbol of one display sector of one display unit of said at least one second rotating wheel are seen.

4. The jewelry as claimed in claim 1, wherein said jewelry body is a fashion ring.

5. The jewelry as claimed in claim 1, wherein said jewelry body is a pendant.

6. The jewelry as claimed in claim 1, wherein the numerical symbols of said at least one rotating wheel include Arabic numerals, Romanic numerals, dots, and Braille.

7. A fashion ring having a ring body and a roulette wheel mounted on said ring body, said roulette wheel comprising at least one rotating wheel fastened to said ring body, said at least one rotating wheel having at least one display unit divided into a plurality of display sectors marked with a numerical symbol, and an indicator means fastened to said ring body and adapted to point out the numerical symbol of one display sector of each display unit of said at least one rotating wheel; wherein said at least one rotating wheel comprises at least one first rotating wheel and at least one second rotating wheel fastened to said ring body, said at least one first rotating wheel comprising a display unit divided into multiple display sectors each marked with a respective numerical symbol and a plurality of sector openings spaced around the display unit of the respective first rotating wheel, said at least one second rotating wheel each comprising a display unit divided into multiple display sectors corresponding to the sector openings of said at least one first rotating wheel and a plurality of sector openings corresponding to the display sectors of one display unit of said first rotating wheel, each display sector of said second rotating wheel being marked with a respective numerical symbol, and said indicator means has a view window through which the numerical symbol of one display sector of said at least one first rotating wheel and the numerical symbol of one display sector of said at least one second rotating wheel are seen.

8. The fashion ring as claimed in claim 7, wherein said at least one rotating wheel comprises at least one first rotating wheel and at least one second rotating wheel fastened to said ring body, said at least one first rotating wheel comprising a display unit divided into multiple display sectors each marked with a respective numerical symbol, said at least one second rotating wheel comprising a display unit divided into multiple display sectors spaced around the display unit of one of said at least one first rotating wheel and marked with a numerical symbol; and said indicator means has a pointer adapted to point out the numerical symbol of one display sector of said at least one first rotating wheel and the numerical symbol of one display sector of said at least one second rotating wheel.

9. The fashion ring as claimed in claim 7, wherein the numerical symbols of said at least one rotating wheel include Arabic numerals, Romanic numerals, dots, and Braille.

10. The fashion ring as claimed in claim 7, wherein said at least one rotating wheel comprises at least one first rotating wheel and at least one second rotating wheel fastened to and received in said indicator means at two sides, said at least one first rotating wheel and said at least one second rotating wheel each comprising at least one display unit extended around the periphery thereof, said at least one display unit being divided into multiple sectors each marked with a respective numerical symbol; and said indicator means is a tubular member fixedly fastened to said ring body, said indicator means having a plurality of view windows through which the numerical symbol of one display sector of one display unit of said at least one first rotating wheel and the numerical symbol of one display sector of one display unit of said at least one second rotating wheel are seen.

11. A pendant having a pendant body and a roulette wheel mounted on said pendant body, said roulette wheel comprising:

at least one rotating wheel fastened to said pendant body, said at least one rotating wheel having at least one display unit divided into a plurality of display sectors marked with a numerical symbol, and an indicator means fastened to said pendant body and adapted to point out the numerical symbol of one display sector of each display unit of said at least one rotating wheel; wherein said at least one rotating wheel comprises at least one first rotating wheel and at least one second rotating wheel fastened to said pendant body, said at least one first rotating wheel comprising a display unit divided into multiple display sectors each marked with a respective numerical symbol and a plurality of sector openings spaced around the display unit of the first rotating wheel, said at least one second rotating wheel comprising a display unit divided into multiple display sectors corresponding to the sector openings of said at least one first rotating wheel and a plurality of sector openings corresponding to the display sectors of one display unit of said first rotating wheel, each display sector of said second rotating wheel being marked with a respective numerical symbol; and said indicator means has a view window through which the numerical symbol of one display sector of said at least one first rotating wheel and the numerical symbol of one display sector of said at least one second rotating wheel are seen.

12. The pendant as claimed in claim 11, wherein said at least one rotating wheel comprises at least one first rotating wheel and at least one second rotating wheel fastened to said pendant body, said at least one first rotating wheel comprising a display unit divided into multiple display sectors each marked with a respective numerical symbol, said at least one second rotating wheel comprising a display unit divided into multiple display sectors spaced around the display unit of said at least one first rotating wheel and marked with a respective numerical symbol; and said indicator means has a pointer adapted to point out the numerical symbol of one display sector of said at least one first rotating wheel and the numerical symbol of one display sector of said at least one second rotating wheel.

13. The pendant as claimed in claim 11, wherein the numerical symbols of said at least one rotating wheel include Arabic numerals, Romanic numerals, dots, and Braille.

14. The pendant as claimed in claim 11, wherein said at least one rotating wheel comprises at least one first rotating wheel and at least one second rotating wheel fastened to and received in said indicator means at two sides, said at least one first rotating wheel and said at least one second rotating wheel each comprising at least one display unit extended around the periphery thereof, said at least one display unit being divided into multiple sectors each marked with a respective numerical symbol; and said indicator means is a tubular member fastened to said pendant body, having a plurality of view windows through which the numerical symbol of one display sector of one display unit of said at least one first rotating wheel and the numerical symbol of one display sector of one display unit of said at least one second rotating wheel are seen.

* * * * *